United States Patent [19]

Hatakeyama et al.

[11] 4,238,042

[45] Dec. 9, 1980

[54] AIR-TIGHT CAP FOR BOTTLE

[75] Inventors: Yoshiharu Hatakeyama; Ichiro Kizawa, both of Tokyo, Japan

[73] Assignee: Yoshida Kogyo Co., Ltd., Japan

[21] Appl. No.: 57,939

[22] Filed: Jul. 16, 1979

[51] Int. Cl.[3] ..... B65D 53/00

[52] U.S. Cl. ..... 215/334; 215/341; 215/343

[58] Field of Search ..... 215/329, 331, 334, 341, 215/343, 344, 345, 354

[56] References Cited

U.S. PATENT DOCUMENTS

| | | | |
|---|---|---|---|
| 2,689,665 | 9/1954 | Martin | 215/334 |
| 3,092,281 | 6/1963 | Davidson | 215/329 X |
| 3,339,773 | 9/1967 | Stull | 215/344 X |
| 3,425,579 | 2/1969 | Braun | 215/329 |
| 4,093,096 | 6/1978 | Augros | 215/331 X |

FOREIGN PATENT DOCUMENTS

| | | | |
|---|---|---|---|
| 522646 | 4/1955 | Italy | 215/341 |

*Primary Examiner*—Donald F. Norton
*Attorney, Agent, or Firm*—William A. Drucker

[57] ABSTRACT

The present invention relates to an extremely useful air-tight cap for bottle, and more particularly an air-tight cap adapted for use in a so-called positioning container wherein a bottle of a non-circular cross section such as a polygonal or oval form is closed by a cap of a same cross section when it is brought to a determined positional relationship with respect to said bottle and capable of achieving tight closure of the cap in such determined position to maintain air tightness and to completely prevent the leak of the content by means of a structure capable of achieving maximum packing effect.

4 Claims, 7 Drawing Figures

AIR-TIGHT CAP FOR BOTTLE

BACKGROUND OF THE INVENTION

In general injection molded plastic caps for bottles are inevitably associated with certain dimensional fluctuations particularly in the screw thread portion thereof, depending upon the material used and the contraction resulting from cooling after the molding step.

Such a cap, when used in combination with such positioning container as mentioned above, is therefore apt to result in an incompletely air-tight closure in the determined closing position due to the dimensional errors in the screw thread portion, thus often giving rise to leakage of the content.

SUMMARY OF THE INVENTION

The present invention is a cap provided therein with a packing of sufficient elasticity and deformability for ensuring close contact with the opening of the container, whereby a secure closure and air-tightness is achieved even with an injection molded plastic cap having certain dimensional error in the screw thread portion thereof when it is brought to a determined closing position with respect to the container.

BRIEF DESCRIPTION OF THE DRAWINGS

The attached drawings illustrate an embodiment of the present invention, wherein.

DETAILED DESCRIPTION OF THE INVENTION

Figure 1:
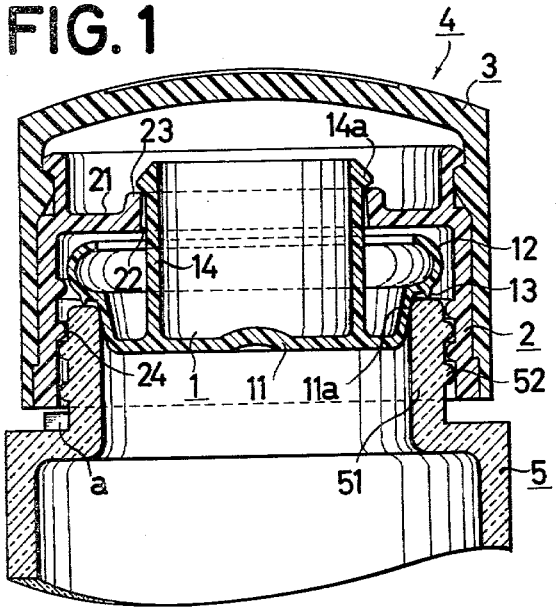
FIG. 1 is a cross-sectional view of the cap of the present invention being fitted on a container.

In the attached drawing showing an embodiment of the present invention, there are shown a packing 1, a cap inner member 2, a cap outer member 3, a cap 4 composed of said packing, cap inner member and cap outer member, and a container 5.

The packing 1 is provided with a closing portion 11 of an inverted truncated conical shape to be fitted into and maintained in close contact with a neck 51 of the container 5, the side wall 11*a* of said closing portion 11 being connected to an annular hollow elastic portion 12 of a semi-circular cross section of which upper part is inwardly curved. Said elastic portion is provided at the outer lower periphery thereof with an annular projection 13 to be brought into pressure contact with the top face of said neck 51. The packing is further provided on the central inner face of said closing portion 11 with a vertical cylindrical support 14 having a flange 14*a* at the upper end thereof, and is entirely formed by an elastic soft plastic material.

The cap inner member 2 comprises an upper wall portion 21 provided at the center thereof with a circular opening 22 for receiving the cylindrical support 14 of said packing 1, said opening 22 being provided along the periphery thereof with a seat ring portion 23 to engage with the flange 14*a* of said cylindrical support 14, and a female thread 24 provided on the internal peripheral wall extended under said upper wall portion to engage with a male thread 52 provided on the opening 51 of the container.

The cap outer member 3 is shaped in a cap form to be fitted on said cap inner member 2.

The cap of the present invention is formed by fitting and securing said cap inner member 2 in said cap outer member 3 and inserting the cylindrical support 14 of the packing 14 upwards through the circular opening 22 of said cap inner member 2, thereby maintaining the packing 1 in a suspended state by means of engagement of the flange 14*a* with the seat ring 23.

Figure 4A:
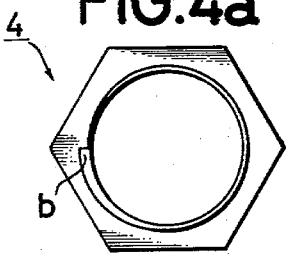
FIG. 4*a* is a bottom view of the cap for a polygonal container provided with a positioning structure; to be employed in the present invention.
Figure 4B:
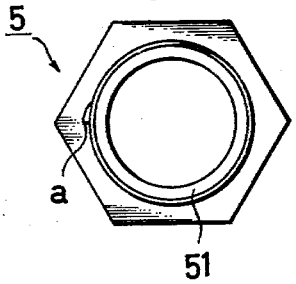
FIG. 4*b* is a top view of the container similarly provided with a positioning structure.

On a shoulder at the bottom portion of the neck 51 of the container 5 and on the bottom face of the cap 4 coming into contact with said bottom portion when said cap is fitted on said opening, there is provided a positioning structure composed of a lug a and an engaging recess b therefor for maintaining said cap and opening at a determined positional relationship (cf. FIGS. 4*a* and 4*b*).

When the cap 4 is placed on said neck 51 for fitting on the container 5, the closing portion 11 of the packing 1 is inserted as shown in FIG. 1 into said neck, with the inclined side wall 11*a* and annular projection 13 of said packing 1 being respectively brought into contact with the inner wall and the top face of said neck.

Upon rotation of the cap outer member 3 to advance the screw engagement of the cap along the male thread 52 of the neck 51, the upper wall portion 21 of the cap inner member 2 descends against the elasticity of the elastic hollow portion 12 of the packing 1 while compressing the annular portion of said packing 1 until the mutual engagement of positioning structures a and b is achieved, where the screwing is completed to realize complete closure of the opening 51.

Figure 3A:
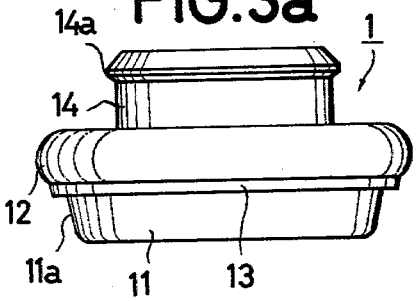
FIG. 3*a* is an elevation view of the packing in a state shown in FIG. 1.
Figure 3B:
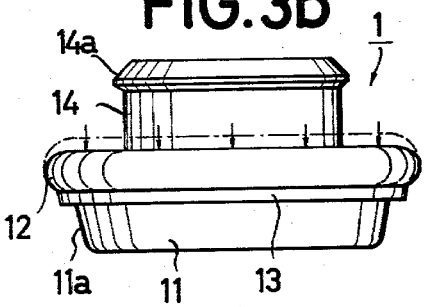
FIG. 3*b* is an elevation view of the packing in the state of FIG. 2 wherein a hollow compressible portion is compressed.
Figure 2:
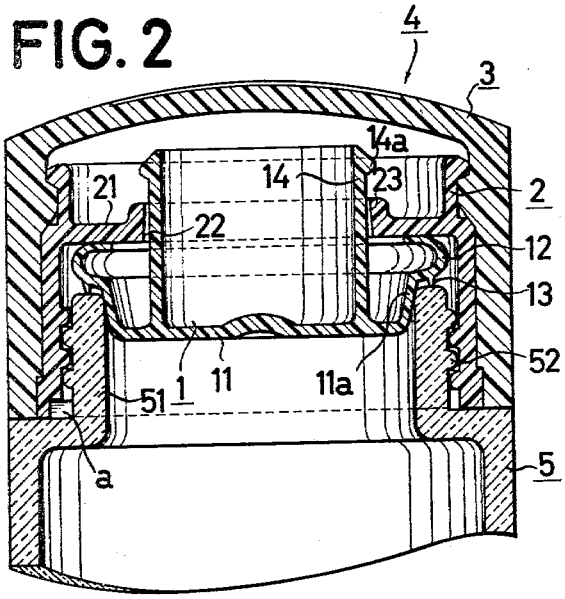
FIG. 2 is a cross-sectional view of the cap in a tightly closing position.

The hollow elastic portion 12 of the packing, being connected to the inclined side wall 11*a* of the closing portion 11 and formed into an annular shape with a semi-circular cross-section with an inwardly curved upper part, is structurally sufficiently resilient and has sufficient elasticity and deformability achieved by the constituent material, and thus is suitably pressed by the upper wall portion 21 of the cap inner member 2. In the compressed state as shown in FIG. 3*b*, the resulting repulsive force inversely biases the cap inner member 2 upwards, thus further ensuring tight and firm closure of the cap 4.

At the same time the closing portion 11 of the inverted truncated conical shape and the annular projection 13 are firmly pressed respectively against the inner face and the top face of the neck 51, thus achieving additional air-tightness.

Besides the elastic hollow portion 12 recovers the original shape immediately when the cap is removed and can therefore endure repeated uses.

Figure 5:
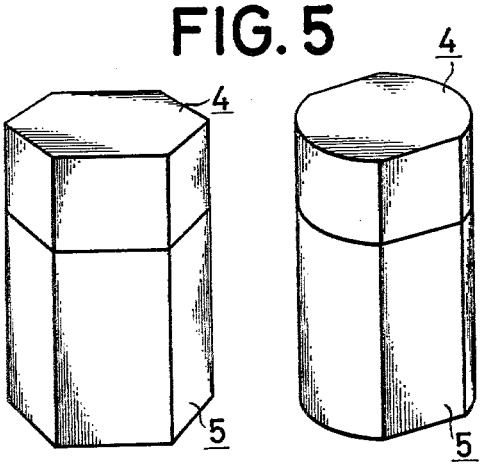
FIG. 5 is a perspective view of an example of a non-circular container requiring a positioning operation.

As explained in the foregoing, the cap of the present invention, capable of achieving a complete closure through suitable adjustment of cap fitting with compensation of dimensional error in the screw threads by means of the hollow elastic portion formed in the packing, is most adapted for use in the positioning containers of various shapes as shown in FIG. 5 for achieving secure and firm closure regardless of the presence of certain dimensional errors in the injection molding of the screw threads, and this is ideal for containers requiring the positioning of the cap for closing.

The positioning structure explained in the foregoing is by no means limited to that composed of a lug and an engaging recess as shown in FIGS. 4*a* and 4*b* but may be composed of other suitable mechanisms.

What is claimed is:

1. A cap, for air-tight engagement onto a container neck having an external thread and an end face about an opening therein, comprising:

(i) a cap member having an internal thread for engagement onto the external thread of the container neck, and an apertured transverse wall, (ii) a packing made of a resiliently deformable material, said packing being disposed in said cap member and having:

(a) a closure portion including a transverse wall with a peripheral frusto-conical side wall for engagement into the opening of the container neck;

(b) a hollow annular portion extending from a broader end of said frusto-conical side wall and positioned so as, when the cap is engaged on the container neck, to be disposed between the end face of the container neck and the transverse wall of the cap;

(c) an annular projection on said hollow annular portion positioned to abut said end face, and (d) a support extending from the transverse wall of the closure portion through the aperture of the transverse wall of the cap member.

2. A cap, as claimed in claim 1, comprising abutment means projecting from said support remote from said closure transverse wall to abut the transverse wall of the cap member and thereby retain the packing captive in the cap member.

3. A cap, as claimed in claim 1, wherein the cap member comprises an inner cap member having said internal thread and said transverse wall, and an outer cap member secured about said inner cap member.

4. A cap member, as claimed in claim 1, wherein said hollow annular portion is of semi-circular cross-section in any axial plane thereof.

* * * * *